United States Patent [19]

Imaizumi et al.

[11] 3,978,369

[45] Aug. 31, 1976

[54] SOLID STATE STARTER APPARATUS FOR A DISCHARGE LAMP

[75] Inventors: Ichiro Imaizumi, Kodaira; Teruichi Tomura, Kunitachi; Mitsuo Akatsuka, Tokyo; Mineo Katsueda, Kokubunji; Toshiaki Okada, Tachikawa; Hiroyuki Iyama, Toyko, all of Japan

[73] Assignee: Hitachi, Ltd., Japan

[22] Filed: Jan. 7, 1975

[21] Appl. No.: 539,117

[30] Foreign Application Priority Data

Jan. 21, 1974 Japan ..... 49-8616

[52] U.S. Cl. ..... 315/99; 315/101; 315/106; 315/205; 315/DIG. 7

[51] Int. Cl.[2] ..... H05B 41/18

[58] Field of Search ..... 315/98–107, 315/205, DIG. 5, DIG. 7

[56] References Cited

UNITED STATES PATENTS 3,705,329 12/1972 Vogeli ..... 315/103

3,857,060 12/1974 Chermin ..... 315/99

3,875,459 4/1975 Remery et al. ..... 315/205

*Primary Examiner*—Siegfried H. Grimm

*Attorney, Agent, or Firm*—Craig & Antonelli

[57] ABSTRACT

A solid state starter apparatus for a discharge lamp comprises a current limiter, an AC power supply, a discharge lamp of filament-preheating type and a switching circuit for controlling the turning on and off of the discharge lamp. The switching circuit further includes a lightedstate detector circuit for detecting the turning on or off of the discharge lamp, a current breaker circuit controlled by the lighted-state detector circuit to cause the filament current to be turned on and off, and a preheater circuit for starting to supply a filament preheating current in accordance with the magnitude of the current controlled by the current breaker circuit.

16 Claims, 16 Drawing Figures

V1
T1 T2 T3 T4 T5 T6 T7 T8 T9 T10 T11
Vc
VFLO
VP
VBOI
DR
VFL
IOFF
IFL
IF

SOLID STATE STARTER APPARATUS FOR A DISCHARGE LAMP

BACKGROUND OF THE INVENTION

1. FIELD OF THE INVENTION

This invention relates to an apparatus for lighting the discharge lamp of filament-preheating type, or more in particular to a switching apparatus comprising a semiconductor switching element for use with the lighting apparatus.

2. DESCRIPTION OF THE PRIOR ART

A conventional lighting apparatus for the discharge lamp of filament preheating type mainly employs a glow starter. The well-known lighting apparatus for the preheating-type discharge lamp using such a glow starter is shown in FIG. 1.

In FIG. 1, reference numeral 1 shows an AC power supply, numeral 2 a current limiter including a choke coil, numeral 4 a switching circuit, numeral 5 a discharge lamp of preheating type (hereinafter referred to only as the lamp), and numeral 3 a capacitor which may be replaced by an equivalent distributed capacity, if any, of the choke coil of the current limiter 2.

The glow starter is inserted in the switching circuit 4 which in turn is connected to those sides of the terminals *a* and *b* of the filaments $F_1$ and $F_2$ respectively which are opposite to the power supply 1. By causing a preheating current to flow in the filaments $F_1$ and $F_2$ of the lamp 5, a pulse voltage required to start the glow is generated thereby to detect the turning on or off of the lamp 5.

This conventional lighting apparatus using a glow starter, however, has the disadvantages that it requires a long time before the lamp is turned on and that the useful life of the glow starter is short. Especially, at and near the end of the life of the glow starter, the time required for the lamp to be turned on is as long as several to several tens of seconds. Also, the glow starter itself must be replaced by new one several times throughout the life of the lamp equipment.

A starter circuit for the discharge lamp of preheating type without the above-mentioned disadvantages is under development by utilizing the silicon symmetrical switch (SSS) or a silicon controlled rectifier (SCR) but has not yet been developed to a commercially effective point.

SUMMARY OF THE INVENTION

An object of the present invention is to provide a discharge lamp lighting apparatus without any disadvantages of the glow starter as mentioned above.

Another object of the invention is to provide a commercially effective lighting apparatus.

Still another object of the invention is to provide a lighting apparatus in solid state.

In order to achieve the above-described objects, according to the present invention, the functions of the glow starter are separated. In other words, the functions to supply a preheating current to the filaments, to generate a pulse voltage required for the lighting and to detect the turning on or off of the discharge lamp are performed by semiconductor switching elements, so that the filaments are heated and the pulse voltage generated alternately at every half cycle of the AC power supply.

DESCRIPTION OF THE PREFERRED EMBODIMENTS

Figure 1:
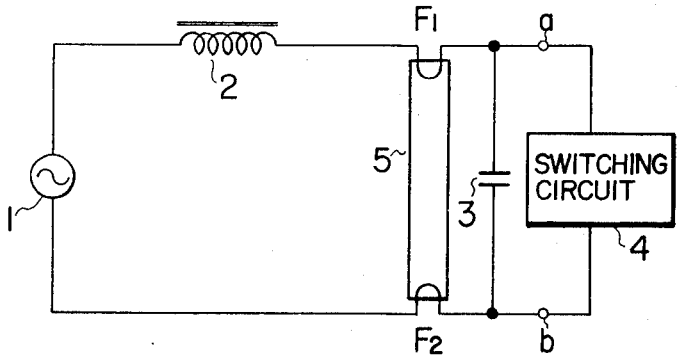
FIG. 1 PRIOR ART
FIG. 1 is a diagram showing the configuration of a conventional lighting apparatus.
Figure 2A:
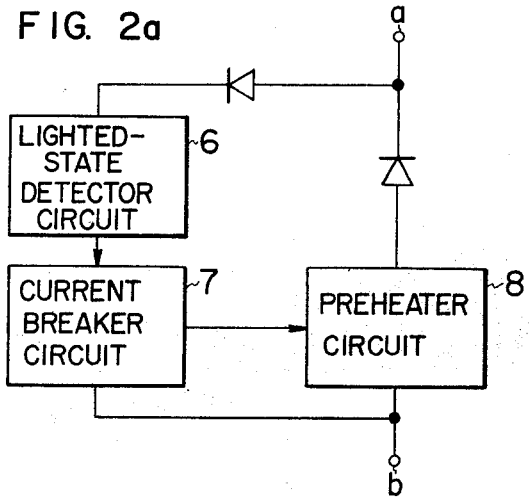
FIG. 2*a* and FIG. 2*b* are diagrams for explaining the construction and operating principle of the lighting apparatus according to the invention.
Figure 2B:
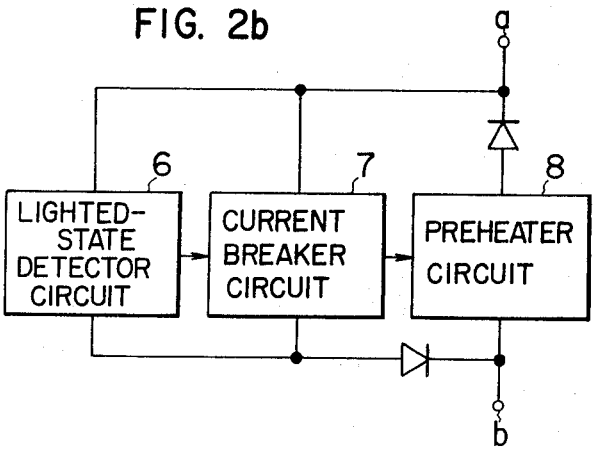

With reference to FIG. 2*a* and FIG. 2*b* showing the operating principle of the switching circuit according to the present invention used in place of switch 4 included in the lighting apparatus of FIG. 1, reference symbols *a* and *b* show terminals which are connected to the terminals *a* and *b* in FIG. 1 respectively. The switching circuit as shown in FIG. 2*a* and FIG. 2*b* comprises a lighted-state detector circuit 6, a current breaker circuit 7 and a preheater circuit 8 and the fundamental operation of the circuit is mentioned as below.

In response to the application of a source voltage, the lighted-state detector circuit 6 energizes the current breaker circuit 7 to generate a pulse voltage prior to the normal turned-on state of the lamp 5. During the next half cycle, the preheater circuit 8 is energized to preheat the lamp substantially from the zero voltage. These processes of operation are repeated. Immediately before the normal turning on of the lamp 5, however, the current breaker circuit 7 is energized to generate a pulse voltage, but during the next half cycle the lamp 5 transfers to a normally turned-on state without energization of the preheater circuit 8. By the way, the lighted state detector circuit 6 and the current breaker circuit 7 are connected in series and parallel in FIG. 2*a* and FIG. 2*b* respectively.

A switching circuit incorporating the abovementioned operating principle will be described below with reference to the accompanying drawings.

Figure 3:
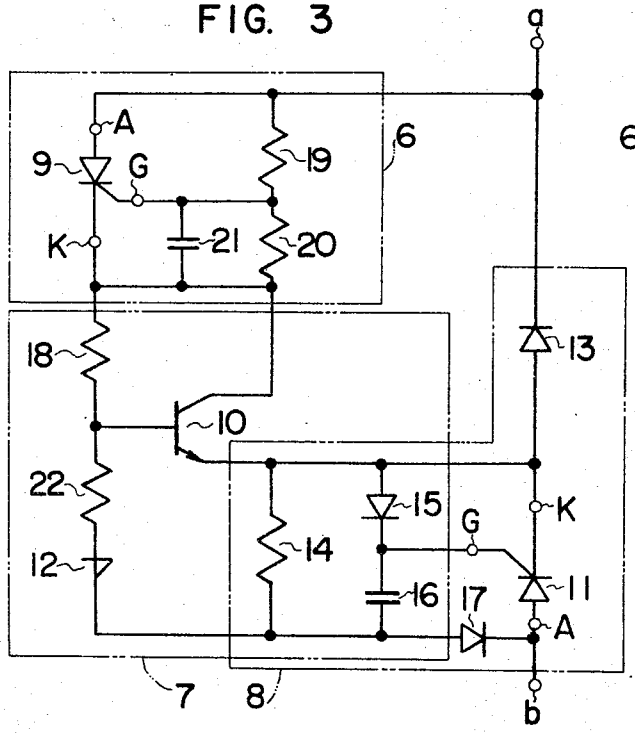
FIG. 3 is a circuit diagram showing an embodiment of the present invention.

FIG. 3 is a circuit diagram showing the configuration of an embodiment of the invention. The other parts of the lighting apparatus including this switching circuit are the same as those shown in FIG. 1. In the drawing under consideration, reference numerals 9 and 11 show triode or three-terminal semiconductor switching elements such as SCRs (hereinafter referred to merely as the switching elements) having the terminals A, G and K for the anode, gate and cathode respectively. Numerals 19 and 20 show resistors for determining the breakover voltage of the switching element 9, numeral 21 a capacitor for performing the integrating action of the switching element 9 to stabilize the operation thereof, numeral 10 a transistor, and numeral 12 a two-terminal semiconductor switching element such as a PNPN switching diode which conducts at least in one direction at the threshold voltage. Numeral 13 shows a diode for the preheater circuit, numeral 17 a diode for blocking a backward voltage, numeral 16 a capacitor for causing the switching element 11 to conduct, numeral 15 a diode for charging the capacitor 16, numeral 14 a resistor for determining the cut-off current, and numeral 18 a resistor for determining the base current of the transistor 10.

Figures 4A, 4B, 4C, 4D:
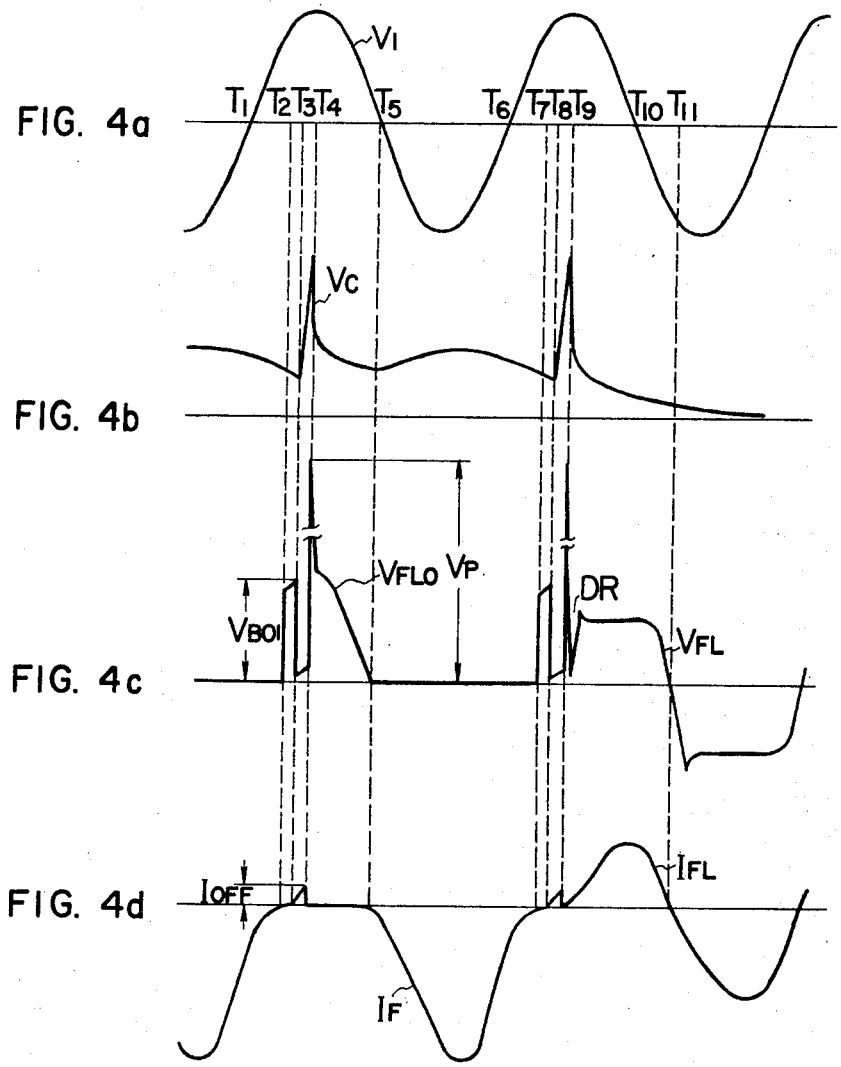
FIGS. 4*a*, 4*b*, 4*c* and 4*d* are diagrams showing waveforms for explanation of the operation of the circuit of FIG. 3.

The operation of the circuit of FIG. 3 will be explained below with reference to FIG. 4*a* to FIG. 4*d*. FIG. 4a shows a waveform of the voltage $V_1$ generated by the AC power supply 1 in FIG. 1; FIG. 4b a waveform of the voltage Vc across the capacitor 16; FIG. 4*c* a waveform of voltage $V_{FLO}$ applied to the lamp when it is energized, and a waveform of voltage $V_{FL}$ of the lamp while it is turned on; and FIG. 4d a waveform of the preheating current $I_F$ flowing in the lamp filaments $F_1$ and $F_2$ at the time of energizing the lamp and a waveform of the lamp current $I_{FL}$ in the turned-on state of the lamp.

The explanation of the operation of the circuit shown in FIG. 3 will be started with the time point $T_3$ at which the source voltage $V_1$ reaches the breakover voltage $V_{BO1}$ of the switching element 9 in the lamp. When the source voltage $V_1$ reaches the breakover voltage $V_{BO1}$, the switching element 9 conducts and the base current is applied to the transistor 10 through the resistor 18, so that an emitter current as shown in FIG. 4d flows in the resistor 14. In the meantime, the capacitor 16 is charged by being impressed with the voltage Vc shown in FIG. 4*b* through the diode 15.

Subsequently, at the time point $T_4$ when the voltage applied between the anode and cathode of the switching element 12 reaches the breakover voltage $V_{BO2}$ thereof with the increase of the voltage across the resistor 14, the base and emitter of the transistor 10 are short-circuited by the switching element 12 through the resistor 14, thereby cutting off the transistor 10.

As a result, the filament current of the lamp, as shown in FIG. 4*d*, transfers from the collector current of the transistor 10 to the current flowing in the resistor 18 and the switching element 12. This sudden change in the filament current causes a voltage to be generated by the inductance component L of the current limiter 2 thereby to generate a pulse voltage $V_P$ of FIG. 4*c* at time $T_4$.

After the generation of the pulse voltage, the fact that the on-state voltage of the switching element 12 is applied between the base and emitter of the transistor 10 causes a base leakage current to occur in the transistor 10, so that the collector current flows through the switching element 9 thereby to generate a slight voltage across the resistor 14.

For this reason, the voltage across the capacitor 16 is as shown in FIG. 4*b*, thus making it impossible for the capacitor 16 to discharge at a voltage lower than the sum of the on-state voltage between the gate and cathode of the switching element 11 and the voltage across the resistor 14. In the next half cycle, therefore, the capacitor voltage Vc permits the switching element 11 to be energized from the zero phase at time $T_5$, thereby enabling a preheating current to flow to the lamp through the diode 13. Incidentally, the resistor 22 is provided for the purpose of increasing and stabilizing the voltage across the resistor 14 and may be done without.

When the current begins to flow from the zero phase as mentioned above, the time during which energy is stored in the current limiter 2 becomes longer, namely, the DC bias increases, thus causing a larger current to flow.

In this case, if there should be no resistance component in the circuit, the flow of the current would end at time point $T_7$ when the value of $V_1$ is maximum, so that the available largest value of the effective current would be three times the current value obtained in the series circuit comprising the power supply 1 and the current limiter 2. Actually, however, the effective current is as shown in FIG. 4d due to the resistance of the lamp filaments and the loss in the current limiter and the switching circuit.

Apart from the manner in which the pulse voltage is generated and the lamp is preheated by the circuit as mentioned above, the explanation will be made below of the stoppage of the lighting action at the point of transition to a normally-lighted state.

As described above, the switching element 9 conducts at time point $T_8$ and the pulse voltage is generated at time point $T_9$. When the lamp begins to transfer to the normally lighted state, the generation of excess ions due to the pulse voltage causes the voltage across the lamp to fall as shown by DR of FIG. 4*c* after the generation of the pulse. As a result, the current flowing in the switching element 9 is reduced below its holding current value, whereupon the switching element 9 is unable to maintain its conducting state and cut off. So is the switching element 12.

Since the breakover voltage $V_{BO1}$ of the switching element 9 is selected at a level higher than the lamp voltage $V_{FL}$, the switching element 9 is never made to conduct and the leakage current of the transistor 10 is supplied only through the resistors 19 and 20, so that substantially no voltage is produced across the resistor 14. The capacitor 16 is discharged to the point where the voltage Vc across the capacitor 16 is reduced below the on-state voltage between the gate and cathode of the switching element 11 as shown by the curve of FIG. 4*b*. Therefore, the switching element 11 cannot conduct during the following half cycle, thus causing the lamp to transfer to the normally-lighted state. This normally lighted state is maintained since the switching element 9 never conducts subsequently.

There are two other forms of transition to the normally-lighted state. In one of them, the generation of the pulse voltage and preheating are repeated until immediately before the transition of the lamp to the normally-lighted state. In view of the fact that ions generated in the lamp by the last-applied pulse voltage remain after the lapse of the next preheating cycle, the transition to the normally-lighted state occurs prior to the energization of the lighting circuit during the cycle following the generation of the previous pulse voltage. In the other form, the amount of charges in the capacitor 16 is changed in accordance with the variations of the waveform of the lamp voltage after the generation of the pulse voltage at a predetermined time point, so that the threshold voltage during the preheating cycle is increased, thereby finally transferring the lamp to the normally-lighted state.

Figure 5:
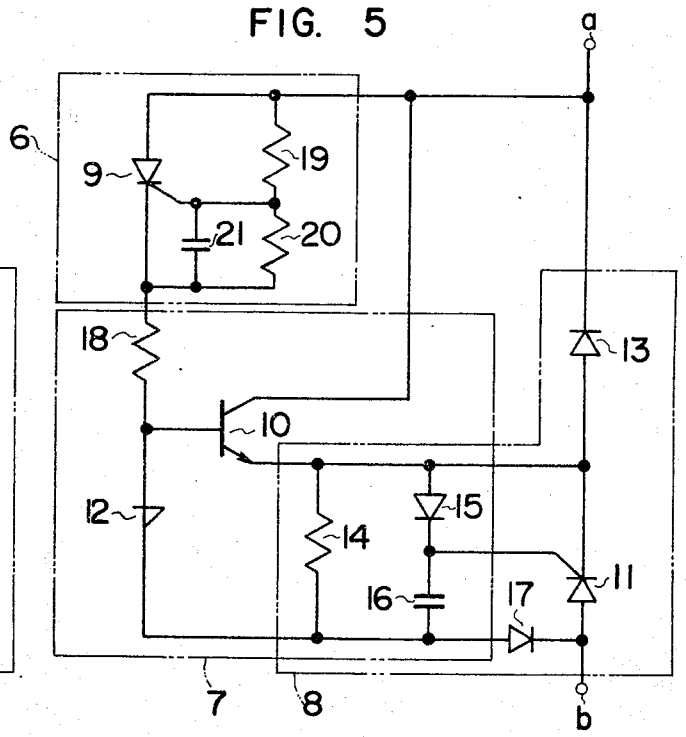
FIG. 5 shows a circuit diagram of another embodiment of the invention.

Other embodiments of the invention are shown in FIG. 5 to FIG. 10. The circuit shown in FIG. 5 is identical to the circuit shown in FIG. 3 except for the fact that the collector of transistor 10 goes directly to terminal *a* rather than the cathode of semiconductor switching element 9. Since, in FIG. 5, semiconductor switching element 9 only has to supply the base current of transistor 10, its current carrying capacity may be made much smaller than the semiconductor switching element 9 in the FIG. 3 circuit. This circuit operates in the same manner as that shown in FIG. 3.

Figure 6A:
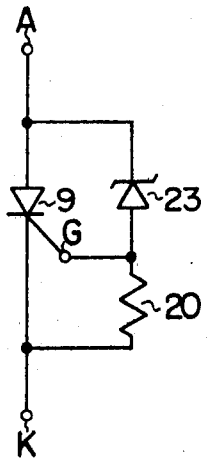
FIGS. 6*a*, 6*b* and 6*c* are diagrams showing other examples of the semiconductor switching circuits for use with the lighting apparatuses shown in FIG. 3 and FIG. 5 respectively.
Figure 6B:
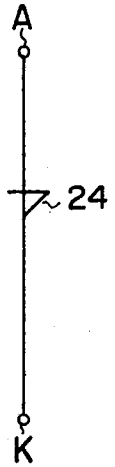
Figure 6C:
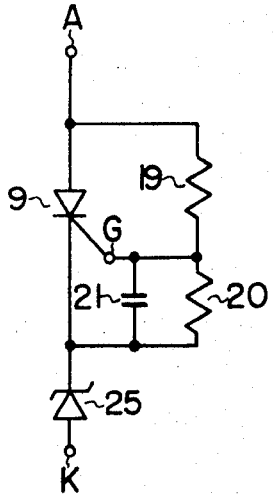

Further, the lighted state detector circuit 6 shown in FIG. 3 and FIG. 5, which is constructed in such a manner as to conduct at the threshold voltage at least in one direction, can be formed as shown by the circuit configuration of FIG. 6*a*, FIG. 6*b* or FIG. 6*c*.

In the circuit of FIG. 6*a*, a zener diode 23 is inserted between the anode and gate of the 3-terminal semiconductor switching element 9 and has a switching characteristic with the zener voltage thereof as a threshold voltage. The circuit of FIG. 6*b* on the other hand, has a semiconductor switching element 24, which like a PNPN switching diode has such a characteristic as to conduct at its threshold voltage at least in one direction. Also, the circuit shown in FIG. 6*c* has a series-connected constant voltage diode 25 in addition to the circuit which conducts at the threshold voltage in at least one direction such as the circuit of FIG. 3 or FIG. 5.

By employing the construction of FIG. 6*c*, the lighted state detector circuit 6 of FIG. 3 and FIG. 5 may be cut off and the lamp may be transferred to the normally lighted state due to the action of the constant voltage diode 25, even if there is a smaller fall of the voltage across the lamp after the generation of the pulse voltage during the transition of the lamp to the lighted state. In this way, it is possible to assure the stability of the circuit operation during the transition to the lamp-lighted state by using the constant voltage diode 25. The lighted state detector circuit 6 may alternatively comprise an SSS or FLS (Triode A.C. Switch) having such a characteristic as to conduct in both directions at the threshold voltage.

Figure 7:
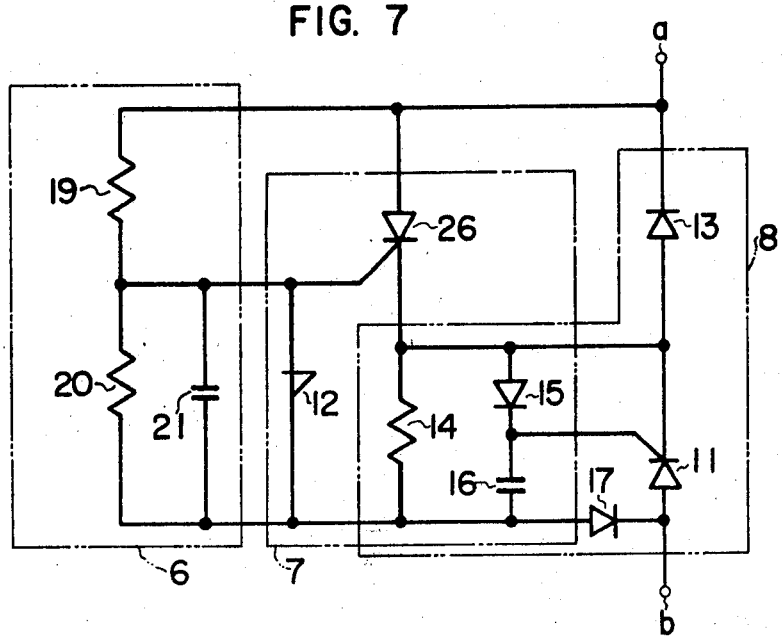
FIG. 7 to FIG. 10 show other embodiments of the invention.

In the circuit of FIG. 7, the lighted state detector circuit 6 comprises resistors 19 and 20 and capacitor 21 inserted in the gate circuit of the 3-terminal semiconductor switching element 26. By the way, the capacitor 21, which is provided for the purpose of giving an integrating function to the switching element 26, may be omitted. The operation of the circuit shown in FIG. 7, which is substantially similar to that of the circuit FIG. 3 or FIG. 5, will be described below.

With the application of a source voltage to the circuit, the switching element 26 conducts first. With the increase in the voltage across the resistor 14, the switching element 12 which conducts at the threshold voltage at least in one direction conducts when the voltage across it reaches its breakover voltage. The switching element 26 is cut off and a pulse voltage is generated as a back bias is applied between gate and cathode of the switching element 26.

After the switching element 26 is cut off, the current flowing in the switching element 12 which is supplied from the resistor 19 becomes lower than the holding current of the switching element 12 and therefore the switching element 12 is cut off. This process of operation is repeated to produce a pulse voltage on each occasion.

After the generation of the last pulse voltage, the switching element 26 conducts again and the capacitor 16 is charged. The voltage across the resistor 14, however, is not enough to energize the switching element 12 and therefore no pulse voltage is produced. During the next cycle, the charges stored in the capacitor 16 cause the switching element 11 to be energized substantially from the zero voltage for preheating. In this way, the embodiment of FIG. 7 produces pulse voltages and performs preheating.

During the transition to the normally lighted state of the lamp, even though the switching element 12 is in the cut-off state after the generation of the pulse voltage, the fact that the voltage across the switching element 26 has changed to the lamp voltage prevents the switching element 26 from being energized. The electric charges stored in the capacitor 16 are released during this cycle, so that the switching element 11 cannot conduct during the next cycle and therefore the lighted state is maintained. Incidentally, the transition to the lamp normally lighted state may take a form similar to that shown in the embodiment of FIG. 3 or FIG. 5.

Figure 8:
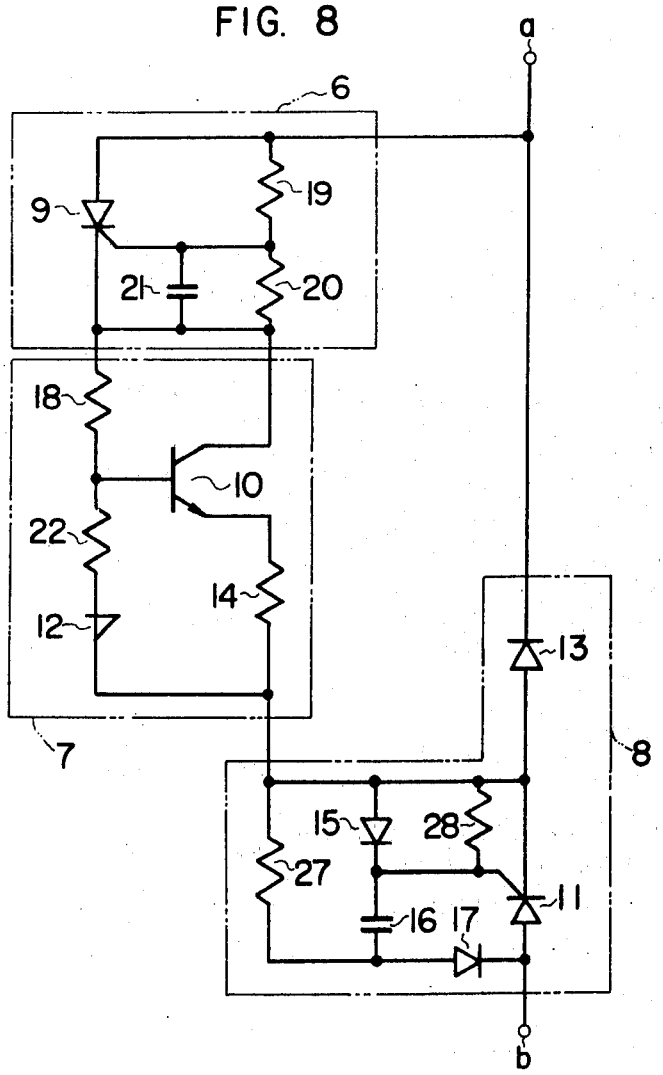
Figure 9:
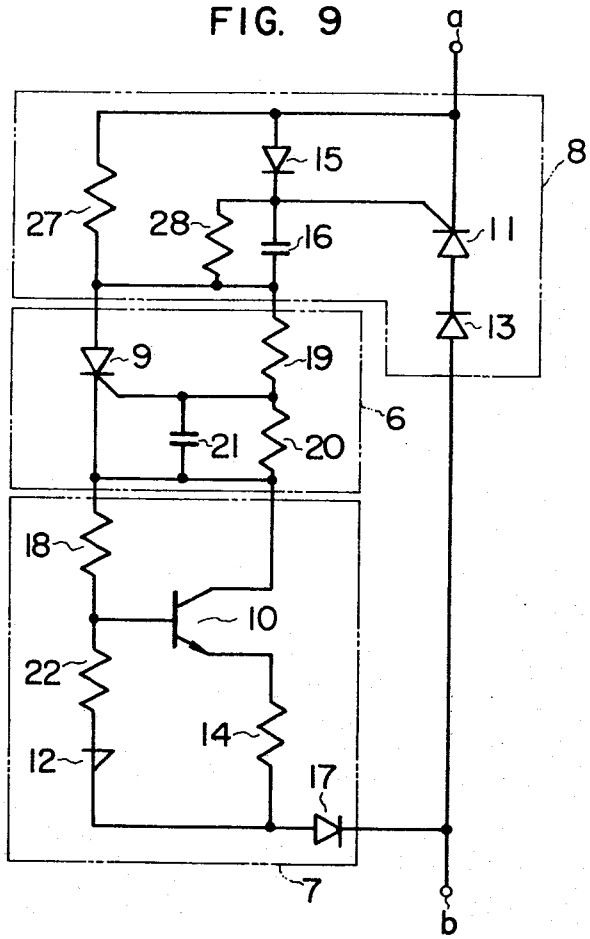

With reference to FIG. 8, the resistor 14 included in the preheater circuit 8 is divided into a resistor 14 for the current breaker circuit 7 and a resistor 27 for the preheater circuit 8, so that the current flowing immediately before the cut-off of the current is determined only by the resistor 14 thereby to assure the stability of the cut-off current. The circuit under consideration operates in a manner similar to the preceding embodiment. By the way, the preheater circuit 8 may alternatively be inserted, as shown in FIG. 9, in the collector side of the transistor 10 used for the current breaker circuit 7.

The resistor 28 inserted between gate and cathode of the switching element 11 is provided for the purpose of eliminating the imbalance of the triggering characteristic of the switching element 11 to assure stability of the circuit. The resistor 28 may be connected in parallel to the capacitor 16 with the same effect. Also, if a thermistor or other heat sensitive element is used in place of the resistor 28, it is possible to compensate for the gate sensitivity characteristic of the switching element 11 whereby the gate sensitivity is improved and deteriorated with the increase and decrease in temperature respectively.

Figure 10:
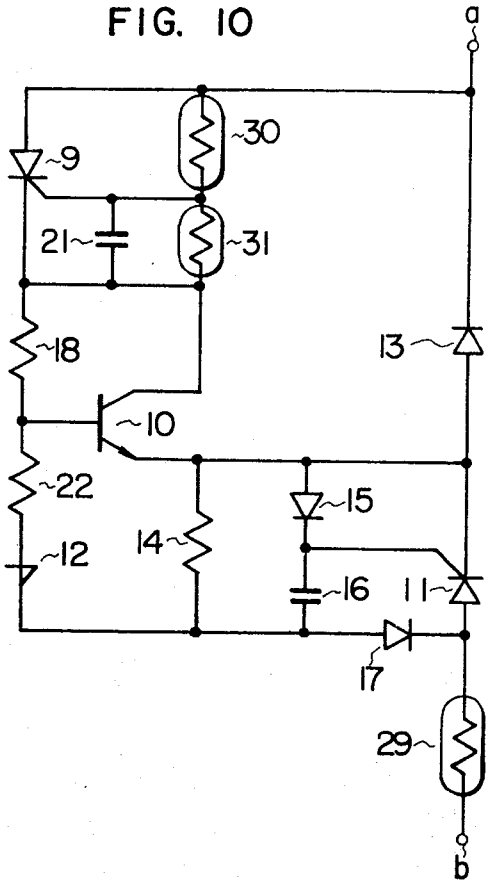

The diagram of FIG. 10 shows still another embodiment of the invention in which part of the circuit resistance of the embodiment of FIG. 3 or a resistor added thereto is replaced by a heat-sensitive resistor element. In the drawing, reference numerals 29 and 30 show posistors, and numeral 31 a thermistor.

Since a large preheating current is involved in the above-mentioned part of the circuit, the longtime repetitive operation of the circuit required in an effort to turn on the lamp near the end of the life thereof is likely to overheat the choke coil thereof. Such an overheating of the choke coil is prevented by inserting the heat sensitive resistor element 29, 30 or 31. Among these heat sensitive elements, the element 30 or 31 is for increasing the breakover voltage of the switching element 9, so that the lamp starting circuit is de-energized in the presence of any heat generated by the element 30 or 31. When the element 29 is heated, on the other hand, the resistance thereof is increased thereby to reduce the preheating current.

In like manner, by employing a heat sensitive resistor element for the resistor 14, the value of the pulse voltage generated may be changed according to the variations in environmental temperature or at the end of the lamp life.

As will be seen from the foregoing description, the present invention provides a circuit comprising a unidirectional switching element which is made to conduct in a half cycle to heat the filaments of the lamp, thereby producing a voltage for lighting the lamp during the next half cycle, wherein the instantaneous lighting of the discharge lamp having preheating electrodes is made possible by increasing the preheating current with a simple construction. Because semiconductors are employed, the lighting circuit according to the invention has a longer life than the conventional glow type circuit, eliminating the need for maintenance and replacement of the starter. In addition, the fact that the semiconductors are used makes possible circuit integration except for the capacitors, resulting in a lower cost of the apparatus.

We claim:

1. A discharge lamp lighting circuit comprising:

an AC power supply having two terminals, current limiter means, a discharge lamp with a pair of filaments, each filament having a first terminal and a second terminal, each first terminal of each filament being connected to one terminal respectively of said AC power supply, said first terminal of one of said filament terminals being connected to one of said terminals of said AC power supply through said current limiter means, a switching circuit connected across both of said second terminals of the respective filaments, each second filament terminal being located on opposite sides of said AC power supply, said switching circuit comprising:

first means connected to one terminal of said second filament terminals for detecting a voltage drop of said discharge lamp produced at a lighting state of said discharge lamp during every half cycle of said AC power supply and for permitting current flowing into said first means from said AC power supply during non-lighted state of said discharge lamp, second means connected to said first means for switching said current flowing into said first means during non-lighted state of said discharged lamp, the switching causing a pulse voltage to be produced by said current limiter means, third means connected to said second means for controlling the starting or stopping of a preheating current for said discharge lamp in accordance with said current flowing into said second means after the origination of said pulse voltage during every next half cycle of said AC power supply, the magnitude of said current flowing into said second means at non-lighted state after the origination of said pulse voltage being larger than that at lighted state of said discharge lamp.

2. A discharge lamp lighting circuit according to claim 1, wherein said first means includes a first 3-terminal semiconductor switching element having an anode, a cathode and a gate as a semiconductor switching element, said anode being connected to one of said second terminals of the respective filaments, a first resistor being connected between said anode and said gate and a second resistor and a first capacitor being connected in parallel between said gate and said cathode.

3. A discharge lamp lighting circuit according to claim 2, wherein said second means includes at least a transistor as a semiconductor switching element, a collector of which transistor is connected to one of said second terminals of the respective filaments, the base being connected to the cathode of said first 3-terminal semiconductor switching element, and a third resistor and 2-terminal semiconductor switching element being connected in series between an emitter and the base of said transistor.

4. A discharge lamp lighting circuit according to claim 3, wherein said third means includes a second 3-terminal semiconductor switching element having an anode, a cathode and a gate as a semiconductor switching element, the cathode of said second 3-terminal semiconductor switching element being connected to the emitter of said transistor and to said one of said second terminals of the respective filaments through a diode which has the same polarity as said second 3-terminal semiconductor switch-element, the anode of said second 3-terminal semiconductor switching element being connected to the other of said second terminals of the respective filaments and to the connection between said third resistor and said 2-terminal semiconductor switching element through a diode for blocking a backward voltage, and the gate of said second 3-terminal semiconductor switching element being connected to the anode of said diode for blocking a backward voltage through a second capacitor and to the cathode of said second 3-terminal semiconductor switching element through a diode for charging current flowing from said transistor to said second capacitor.

5. A discharge lamp lighting circuit according to claim 3, wherein the collector of said transistor is connected to said one of second terminals of the respective filaments through said first and second resistor.

6. A discharge lamp lighting circuit according to claim 1, wherein said first means includes a first 3-terminal semiconductor switching element having an anode, a cathode and a gate as a semiconductor switching element, and said anode being connected to one of said second terminals of the respective filaments, said gate being connected to said anode through a diode for providing a constant predetermined voltage and to said cathode through a first resistor.

7. A discharge lamp lighting circuit according to claim 6, wherein said second means includes a transistor as a semiconductor switching element, the collector of said transistor being connected to said one of second terminals of the respective filaments, the base of said transistor being connected to the cathode of said first 3-terminal semiconductor switching element, and a second resistor and a 2-terminal semiconductor switching element being connected in series between said emitter and said base of said transistor.

8. A discharge lamp lighting circuit according to claim 7, wherein said third means includes a second 3-terminal semiconductor switching element having an anode, a cathode and a gate as a semiconductor switching element, said cathode of said second 3-terminal semiconductor switching element being connected to the emitter of said transistor and to said one of second terminals of the respective filaments through a diode which has the same polarity as said second 3-terminal semiconductor switching element, the anode of said second 3-terminal semiconductor switching element being connected to the other of said second terminals of the respective filaments and to the connection between said second resistor and said 2-terminal semiconductor switching element through a diode for blocking a backward voltage, and the gate of said second 3-terminal semiconductor switching element being connected to said diode for blocking a backward voltage through a first capacitor and to the cathode of said second 3-terminal semiconductor switching element through a diode for charging current flowing from said transistor to said first capacitor.

9. A discharge lamp lighting circuit according to claim 5, wherein said third means includes a second 3-terminal semiconductor switching element having an anode, a cathode and a gate as a semiconductor switching element, the cathode of said second 3-terminal semiconductor switching element being connected to the emitter of said transistor and to said one of said second terminals of the respective filaments through a diode which has the same polarity as said second 3-terminal semiconductor switching element, the anode of said second 3-terminal semiconductor switching element being connected to the other of said second terminals of the respective filaments and to the connection between said third resistor and said 2-terminal semiconductor switching element through a diode for blocking a backward voltage, and the gate of said second 3-terminal semiconductor switching element being connected to said diode for blocking a backward voltage through a second capacitor and to the cathode of said second 3-terminal semiconductor switching element through a diode for charging current flowing from said transistor to said second capacitor.

10. A discharge lamp lighting circuit according to claim 1, wherein said first means includes a two terminal semiconductor switching element which is capable of conducting a current in one direction when the voltage across its terminals exceeds a specific value inherent in the semiconductor.

11. A discharge lamp lighting circuit according to claim 1, wherein said first means includes a first 3-terminal semiconductor switching element having an anode, a cathode and a gate as a semiconductor switching element, said anode being connected to one of said second terminals of the respective filaments, a first resistor being connected between said anode and said gate and a second resistor and a first capacitor being connected in parallel between said gate and said cathode, and a diode for providing a constant predetermined voltage connected to said cathode.

12. A discharge lamp lighting circuit according to claim 1, wherein said first means includes two resistors in series, the first of which being connected to one of said second terminals of the respective filaments.

13. A discharge lamp lighting circuit according to claim 12, wherein said second means includes a first 3-terminal semiconductor switching element having an anode, a cathode and a gate as a semiconductor switching element, said anode being connected to one of said second terminals of the respective filaments, the gate being connected to the junction of said two series resistors and a third resistor and 2-terminal semiconductor switching element being connected in series between said gate and said cathode of said semiconductor switching element.

14. A discharge lamp lighting circuit according to claim 13, wherein said third means includes a second 3-terminal semiconductor switching element having an anode, a cathode and a gate as a semiconductor switching element, the cathode of said second 3-terminal semiconductor switching element being connected to the cathode of said first 3-terminal semiconductor switching element and to said one of said second terminals of the respective filaments through a diode which has the same polarity as said second 3-terminal semiconductor switching element, the anode of said second 3-terminal semiconductor switching element being connected to the other of said second terminals of the respective filaments and to the connection between said third resistor and said 2-terminal semiconductor switching element through a diode for blocking a backward voltage, and the gate of said second 3-terminal semiconductor switching element being connected to the anode of said diode for blocking a backward voltage through a second capacitor and to the cathode of said second 3-terminal semiconductor switching element through a diode for charging current flowing from said first 3-terminal semiconductor switching element to said second capacitor.

15. A discharge lamp lighting circuit according to claim 5, wherein said third means includes a second 3-terminal semiconductor switching element having an anode, a cathode and a gate as a semiconductor switching element, the cathode of said second 3-terminal semiconductor switching element being connected to the emitter of said transistor and to said one of said second terminals of the respective filaments through a diode which has the same polarity as said second 3-terminal semiconductor switching element, the anode of said second 3-terminal semiconductor switching element being connected to the other of said second terminals of the respective filaments and to the connection between said third resistor and said 2-terminal semiconductor switching element through a diode and an additional resistor for blocking a backward voltage, and the gate of said second 3-terminal semiconductor switching element being connected to said diode for blocking a backward voltage through a second capacitor and to the cathode of said second 3-terminal semiconductor switching element through a diode for charging current flowing from said transistor to said second capacitor.

16. A discharge lamp lighting circuit according to claim 9, wherein said first and second resistors are temperature dependent resistors and an additional temperature dependent resistor is inserted between the junction of the anode of said second 3-terminal semiconductor switching element with said diode for blocking a backward voltage, and said second terminal of the respective filament.

* * * * *